United States Patent [19]

Sing

[11] Patent Number: 4,765,548

[45] Date of Patent: Aug. 23, 1988

[54] GARBAGE DISPOSAL APPARATUS

[76] Inventor: Peter Sing, 168-10 84th Ave., Jamaica Hill, N.Y. 11432

[21] Appl. No.: 899,864

[22] Filed: Aug. 25, 1986

[51] Int. Cl.[4] ..... B65D 90/02; B65F 1/00

[52] U.S. Cl. ..... 241/101.3; 220/1 T; 220/262; 220/348; 340/328; 340/692

[58] Field of Search ..... 220/1 T, 334, 262, 345, 220/348, 263; 116/202, 307, 100; 241/101.3; 340/19 A, 568, 569, 692, 540, 545, 328; 232/36

[56] References Cited

U.S. PATENT DOCUMENTS 1,730,744 10/1929 Passman ..... 220/348 X
4,100,581 7/1978 Slack et al. ..... 340/692 X

FOREIGN PATENT DOCUMENTS 576097 5/1959 Canada ..... 220/1 T

*Primary Examiner*—Mark Rosenbaum
*Attorney, Agent, or Firm*—Nathaniel Altman

[57] ABSTRACT

Garbage disposal apparatus of the type used in fast food restaurants for receiving refuse from food trays has a garbage-receiving cabinet with a vertically slidable door panel operated by a pedal-actuated mechanism, permitting two-handed handling of the food trays. The door panel is retracted by pedal action, leaving an unobstructed access opening available for assured, non-spilling sanitary dumping, as long as the pedal is depressed. The mechanism is supported protectedly and visibly in the space provided between two parallel vertical panels which together form the receiving cabinet front, the foremost of the two panels being transparent. Also positioned in the space between the two front panels is a sound-generating system, activated by the movement of either the door panel or the mechanism moving it.

16 Claims, 3 Drawing Sheets

GARBAGE DISPOSAL APPARATUS

FIELD OF THE INVENTION

This invention relates to garbage disposal apparatus of the type widely used in fast-food restaurants and the like, into which the waste contents of a food tray are emptied through a self-closing door panel.

DESCRIPTION OF THE PRIOR ART

Present-day garbage disposal receptacles have a springhinged door panel against which the food tray to be emptied is pushed and then tipped, in order to deposit the waste material on the tray into the garbage container. However, if both hands of the tray-carrier are used to hold the tray, no space can exist between the tray and the door panel being held open, which forces the waste material to fall from the sides of the tray, and all too frequently, on the floor or at least outside the garbage receptacle. If, on the other hand, one hand is used to push the door panel open, the danger of tray-tipping threatens to achieve the same result. In either case, the unsanitary, unsightly mess must be cleaned up; and since the experience of tray-spilling is not uncommon, the cost of labor in maintaining appearance and cleanliness is significantly increased.

SUMMARY OF THE INVENTION

The objects of this invention are to provide garbage disposal apparatus of the type described above but which overcomes all the disadvantages of the prior art, and which at the same time is sanitary, efficient, attractive, educational and even amusing or diverting. These objects are realized by providing a garbage disposal apparatus having a pedal-operated mechanism for sliding a door panel vertically downward to expose completely and unobstructedly the access opening into the garbage container cabinet. Easy and accurate dumping of the trays each held with both hands is assured by the foot-controlled operation, and release of the pedal returns the apparatus to its closed position still in a clean and sanitary state.

The pedal-controlled mechanism may be mounted operatively between two vertically disposed panels positioned at the front of the garbage container, whereby the mechanism, except for the pedal, is substantially covered, kept clean, protected, and easily maintained or replaced when necessary. The frontmost of the two vertical panels protecting and supporting the door panel control mechanism, as well as the door panel itself, may by fashioned from transparent material to permit those who use the disposal unit to observe the operation and movement of the door panel control mechanism. In addition, a sound-producing device may be provided, which, on being activated by the opening of the foot-controlled door panel, emits any preselected sounds such as music, voiced comments possibly including thank yous, congratulations for neatness in using the garbage disposal unit, instructive talks to children, advertising, etc.; and other conceivable sounds such as dog barking or the like. The mechanism's visibility and the sound production features will attract, entertain, and encourage more diners, especially youngsters, to make greater use of the garbage disposal apparatus in a neat manner and thus reduce the amount of labor needed from clean-up crews.

DESCRIPTION OF THE PREFERRED EMBODIMENTS

Figure 1A:
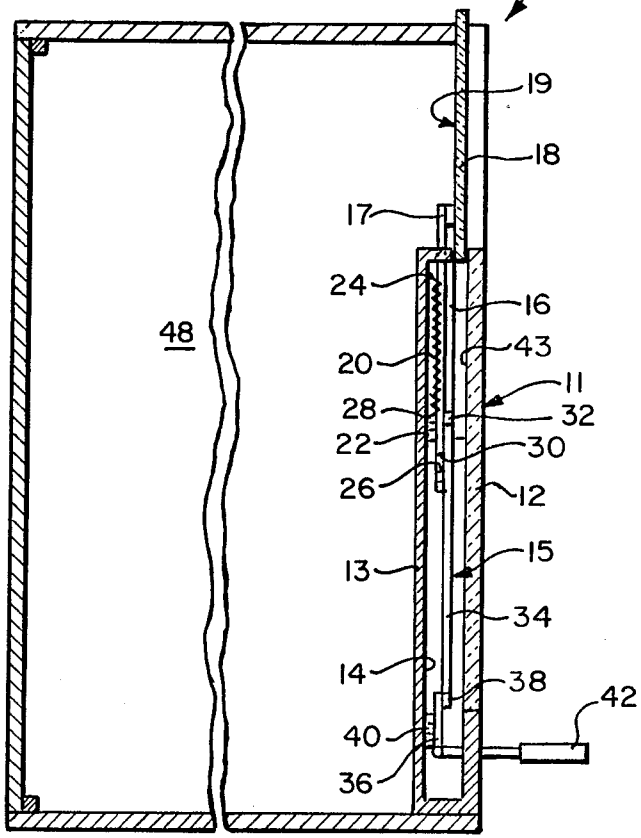
FIG. 1A is a sectional view taken along line 1A—1A of FIG. 1.
Figure 1:
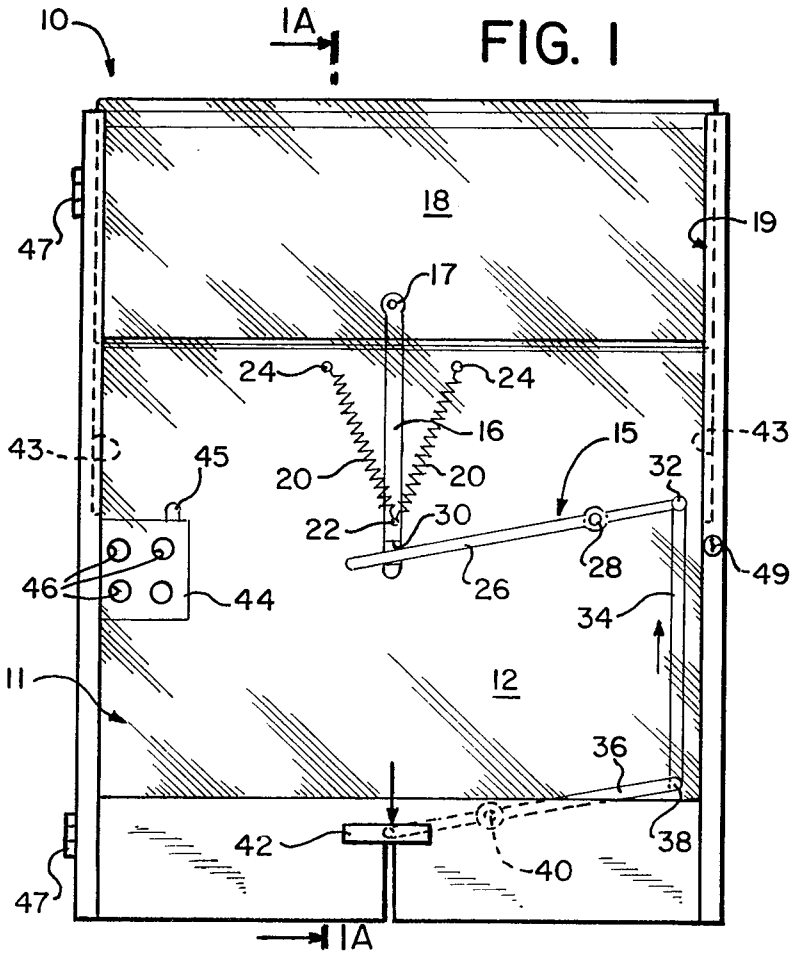
FIG. 1 is a somewhat schematic front elevational view of apparatus illustrative of this invention.

In FIGS. 1 and 1A, the novel garbage disposal apparatus of this invention comprises a container cabinet generally designated 10 shown with a front wall assembly 11 comprising a transparent front panel 12 and vertical wall 13 behind it. Walls 12 and 13 are spaced apart forming a chamber 14 therebetween to contain protectively and to support substantially all of door-operating mechanism 15, which is visible through front panel 12 of cabinet 10.

Mechanism 15 comprises a vertically disposed link 16 connected at 17 to door panel 18, which normally keeps closed the opening 19 in cabinet front wall assembly 11, being urged upwardly by compression springs 20,20; these springs are connected at 22 to link 16 and divergently therefrom to wall panel 13 at 24,24. A lever 26, pivotly attached at 28 to wall 13, has one end extending through slot 30 provided near the lower end of link 16, the other end of lever 26 being operatively connected at 32 to the upper end of vertically disposed link 34. In turn, the lower end of link 34 is operatively connected to one end of lever 36 at 38; lever 36 is pivotally attached to wall 13 at 40, and its other end carries pedal 42, positioned forwardly of cabinet 10. As may readily be seen, when pedal 42 is stepped on, mechanism 15 is actuated to pull door panel 18 slidably down in guide grooves 43,43 against the force of springs 20,20, and thereby access opening 19 of cabinet 10 is held unobstructedly open until pedal 42 is released, at which point tray-dumping opening 19 is automatically reclosed by the action of springs 20,20 returning door panel 18 to its normal position.

Also located in space chamber 14 of front wall assembly 11 is sound-generating device 44 having switch stud 45 projecting upwardly therefrom and positioned to be depressed by the bottom edge 46 of door panel 18 when pedal 42 reaches its lowest position, closing the circuit of device 44 and causing pre-selected pre-recorded sounds to be emitted through openings 47 in transparent front wall panel 12. The pre-recorded sounds may be music, a verbal message, advertising, an animal sound, thank yous, congratulations, etc., and may be programmed to continue even after door panel 18 has reclosed tray access opening 19.

It should be noted that: door panel 18 as well as front wall panel 12 may be formed of transparent material to permit observation of mechanism 15 in chamber 14 during its operation; front wall assembly 11, protecting and supporting mechanism 15, together with door panel 18, serve as a front door to cabinet 10, and are hingedly connected thereto at 41,41 and secured thereto by lock 49. Cabinet 10 is openable thereby for access to garbage-holding chamber 48, for example to remove a bagful of collected garbage (not shown), or for maintenance, repair or replacement of mechanism 15.

Figure 2:
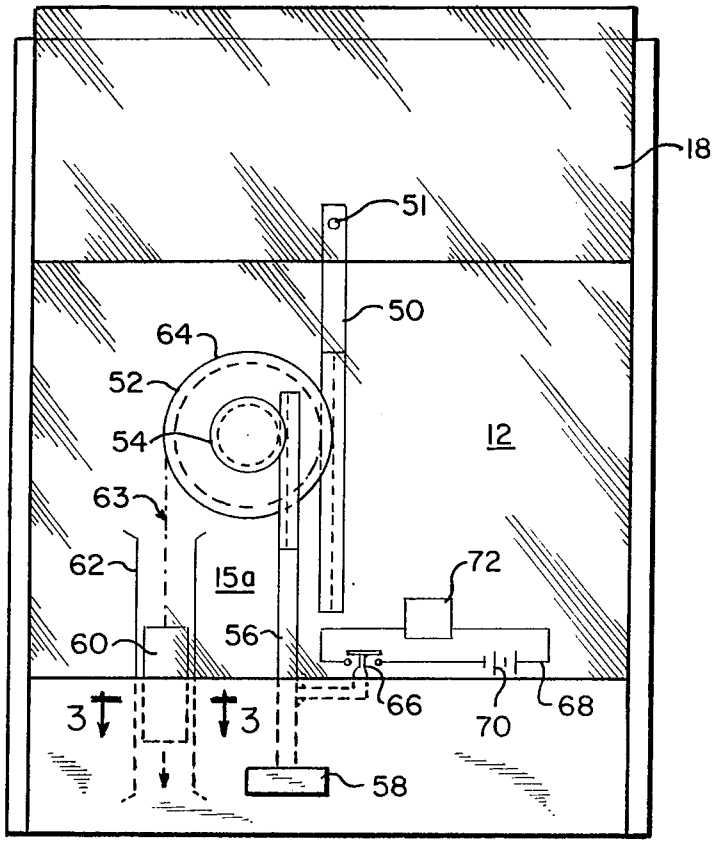
FIG. 2 is a schematic view similar to FIG. 1 of another embodiment of this invention.

FIG. 2 schematically shows door panel operating mechanism 15*a*, comprising a vertically disposed rack 50, connected to door panel 18 at 51 and engaged operatively by pinion gear 52, which is coaxial with, and driven by, smaller pinion gear 54. In turn, gear 54 is operatively engaged by vertically disposed rack 56, carrying projecting pedal 58 at its lower end. Gravity biasing means are provided for mechanism 15*a* in the form of weight 60 in guide channel 62 and supported by cord 63, which, in turn, is held on spool 64 mounted on, and simultaneously rotated with, gear 52. When pedal 58 is depressed, door panel 18 is moved downwardly and weight 60 is raised; upon release of pedal 58, weight 60 is pulled downwardly by gravity, reversing the rack-and pinion action described above and restoring door panel 18 to its normal position.

Rack 56 carries the arm of switch 66, which closes when pedal 58 is pressed, thereby closing and activating circuit 68 containing battery 70 and computer 72, which proceeds to play a pre-selected sound program for the disposal cabinet user to hear.

Figure 3:
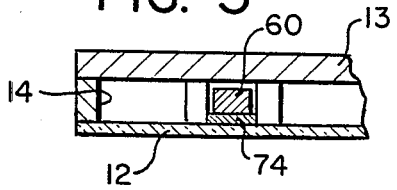
FIG. 3 is a sectional view taken along line 3—3 of FIG. 2.

In FIG. 3, a shield 74 is positioned between window panel 12 and weight 60 for the protection of panel 12 as weight 60 is raised and lowered by the operation of mechanism 15*a*. Similar shielding (not shown) may be provided for other moving parts of mechanism 15*a*.

Figure 4:
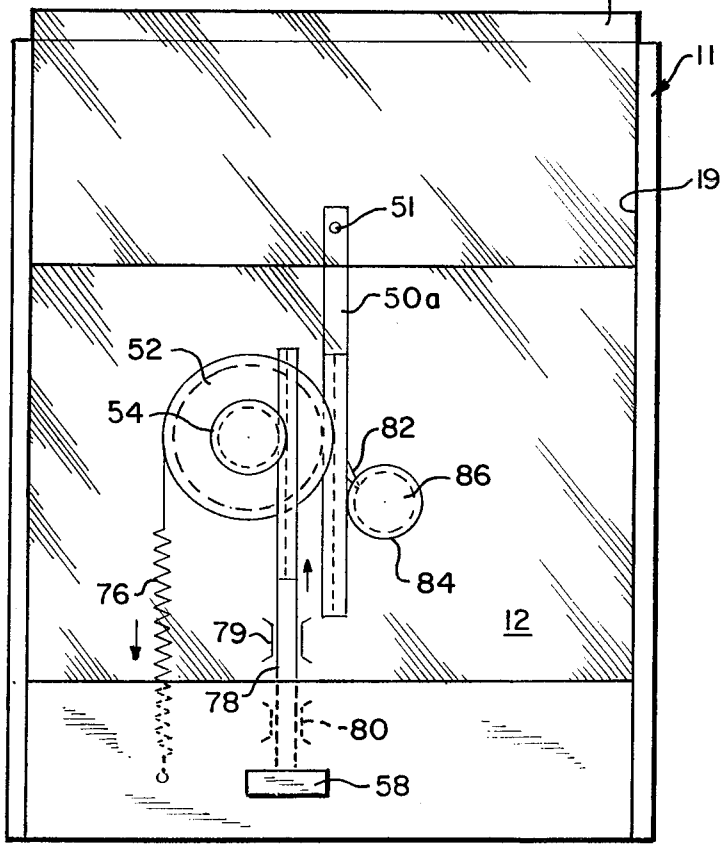
FIG. 4 is a schematic view similar to FIG. 1 of still another embodiment of this invention.

The embodiment of FIG. 4 replaces weight 60 of FIG. 2 with tension spring 76, and provides rack 78 with vertical guides 79 and 80. Also in this modification, link 50*a* carries on its lower right side, as shown, a pawl arrangement 82 operatively engaged with, and for one-way rotation of, rotary gear 84 which operates mechanical record player 86. Pre-recorded sounds are played on device 86 when link 50*a* is moved downwardly along with door panel 18 to expose access opening 19 of disposal cabinet 10, but it is by-passed on link 50*a*'s upward return.

Figure 5:
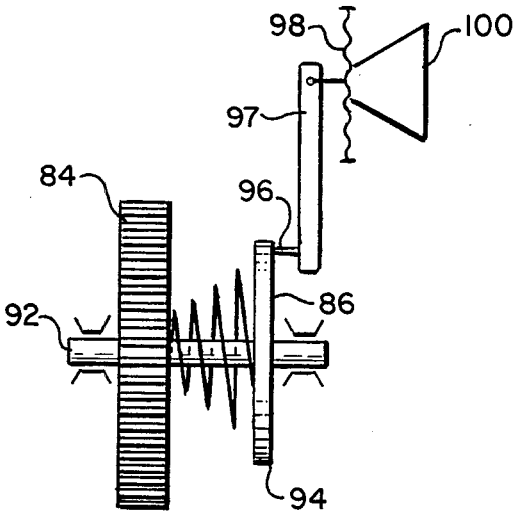
FIG. 5 is an enlarged side elevational view of the record player shown in FIG. 4.
Figure 6:
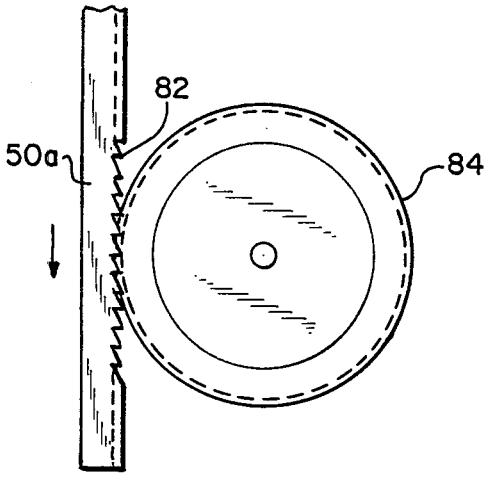
FIG. 6 is an end elevational view of the device of FIG. 5.

Details of mechanically operated record player 86 are shown in FIGS. 5 and 6, where rotary gear wheel 84 is carried by shaft 92, which also carries record disc 94, shown in contact with needle 96 mounted on playing arm 97. Arm 97 is shown schematically operatively connected to diaphragm 98 of speaker 100. In this case, as the pedal-controlled mechanism moves door panel 18 downwardly, record-playing device 86 is played and produces its pre-recorded sounds; on the return movement of the door control mechanism, playing arm 97 and needle 96 are diverted from the surface of record disc 94 by conventional mechanical means (not shown). It should be apparent that record player 86 may be replaced in the embodiment of FIG. 4 by the electronically operated sound-generating device 44 of FIG. 1 or the similarly activated computer system of FIG. 2.

Although only a few embodiments of this invention have been shown and described, it will be apparent to those skilled in the art that various changes may be made therein without departing from the spirit of the invention or from the scope of the appended claims.

What is claimed is:

1. Garbage disposal apparatus for receiving the waste dumped from food trays, which comprises:

a garbage-receiving cabinet having top and bottom members both horizontally disposed, said top and bottom members being connected by vertically disposed side walls and a vertically disposed rear wall; and a front wall assembly substantially constituting the front face of said cabinet and hingedly mounted thereon, comprising:

a pair of vertically disposed parallel walls, each of said parallel walls extending upwardly from said bottom member of said garbage-receiving cabinet to a point below and short of said top member of said garbage-receiving cabinet, the resulting space left between said top member and the tops of said parallel walls thereby forming an access opening for the insertion of garbage-bearing trays and for the dumping of refuse from these trays into said cabinet, said parallel walls being spaced from each other to form a chamber therebetween;

a vertically disposed door panel of a thickness to fit slidably between said parallel walls within said chamber, said door panel being dimensioned and normally positioned to close said access opening between said top member and said tops of said parallel walls and capable of being moved reciprocally in vertical direction downwardly between said parallel walls to uncover said access opening for tray-dumping and upwardly to re-close said access opening; and pedal-operated mechanical means for sliding said door panel vertically and reciprically, first to uncover, and subsequently to re-cover said access opening, said mechanical means being operatively mounted within said chamber between said parallel walls, said chamber being closed at its lower end by said bottom member of said cabinet and substantially closed at its upper end by said vertically reciprocating door panel, whereby said mechanical means are shielded within said chamber both from the refuse being dumped into said garbage-receiving cabinet and from damage from outside said cabinet, and whereby said door panel is also protected from the garbage being dumped when said access opening is exposed and said door panel is in its lowermost position between said parallel walls and within said chamber.

2. Garbage disposal apparatus in accordance with claim 1, wherein the rearward one of said two parallel walls has mounted thereon and supports said pedal-operated mechanical means.

3. Garbage disposal apparatus in accordance with claim 1, wherein the forward front-facing one of said two parallel walls is transparent to permit observation of the operation of said pedal-controlled mechanical means within said chamber.

4. Garbage disposal apparatus as defined by claim 1, further comprising a means for producing and distributing pre-selected sounds, said sound-producing means being activated by the operation of said pedal-controlled mechanical means.

5. Garbage disposal apparatus in accordance with claim 4, wherein said sound-producing means is mounted protectedly and visibly within said chamber between said two parallel walls and comprises a switch positioned to be closed when contacted by the leading edge of said door panel as said door panel reaches the end of its sliding movement away from said access opening.

6. Garbage disposal apparatus in accordance with claim 4, wherein said sound-producing means is powered electrically.

7. Garbage disposal apparatus in accordance with claim 4, wherein said sound-producing means comprises a computer programmed to emit pre-selected sounds when actuated.

8. Garbage disposal apparatus in accordance with claim 4, wherein said sound-producing means comprises a mechanical record player powered by the movement of said pedal-operated mechanical means.

9. Garbage disposal apparatus as defined by claim 1, wherein said pedal-operated mechanical means comprises:

vertically disposed cooperative linkage means connected to and for moving said door panel reciprocally up and down;

biasing means for maintaining said door panel in, and returning said door panel to, a normal position covering said access opening; and a pedal operatively connected to said vertically disposed linkage means for actuating said pedal-controlled mechanical means.

10. Garbage disposal apparatus as defined by claim 9, wherein said biasing means comprises at least one compression spring, being attached at one end to said rearward one of said parallel walls and extending to the attachment of its other end to said linkage means.

11. Garbage disposal apparatus as defined in claim 10, wherein said at least one compression spring comprises a pair of springs connected so that they each diverge upwardly and oppositely with respect to each other, thereby providing balanced support for both said linkage means and said door panel in their normal rest positions.

12. Garbage disposal apparatus as defined in claim 9, wherein said linkage means comprises a pantographic arrangement of connected links for translating the movement of said pedal into the movement of said door panel both for exposing said access opening for tray-emptying as well as for re-closing said access opening thereafter.

13. Garbage disposal apparatus as defined by claim 1, wherein said pedal-operated mechanical means comprises:

a first vertically disposed rack connected to said door panel;

a first pinion gear operatively engaging said first rack;

a smaller second pinion gear coaxial with, and mounted for simultaneous rotation with, said first pinion gear;

a second vertically disposed rack operatively engaging said second pinion gear;

a pedal mounted on said second rack; and a weight suspended by a cord attached to a spool mounted on, and rotatable with, said pinion gears, said spool winding said cord to raise said weight when said pedal is depressed, said weight lowering itself by gravity and restoring said pedal-operated mechanical means and said door panel to their original positions when said pedal is released.

14. Garbage disposal apparatus as defined by claim 13, further comprising:

at least one guide for controlling the path of the rise and fall of said weight; and shielding means for protecting said front wall assembly from potential damage from the movement of any of the components of said pedal-operated mechanical means.

15. Garbage disposal apparatus as defined by claim 1, comprising:

said pedal-operated mechanical means comprises rack-and-pinion motion translation means; and sound-producing means activated by the movement of said rack-and-pinion means.

16. Garbage disposal apparatus as defined by claim 1, wherein said front wall assembly, said door panel and said pedal-operated mechanical means together comprise a front door, hingedly connected to, and removable from, said garbage-receiving cabinet.

* * * * *